United States Patent [19]

Fleming et al.

[11] 4,146,339

[45] Mar. 27, 1979

[54] APPARATUS FOR FILLING STAPLE DEPRESSIONS

[75] Inventors: Michael R. Fleming, Vista; Ora R. Fleming, Pico Rivera, both of Calif.

[73] Assignee: Fleming Caster Industries, Inc., El Cajon, Calif.

[21] Appl. No.: 784,046

[22] Filed: Apr. 4, 1977

[51] Int. Cl.[2] ..... B27F 7/06

[52] U.S. Cl. ..... 401/195; 401/9; 401/52; 222/252; 222/263; 227/14; 156/52; 156/390; 118/243; 118/263

[58] Field of Search ..... 401/9, 52, 146, 195; 227/14, 130; 222/387, 389, 263, 252; 156/91, 92, 390; 118/243, 263; 428/61; 81/15.7

[56] References Cited

U.S. PATENT DOCUMENTS

| | | | |
|---|---|---|---|
| 2,300,398 | 11/1942 | Ames | 401/9 |
| 2,533,839 | 12/1950 | Robinson | 222/252 |
| 3,252,624 | 5/1966 | Watson | 222/252 |
| 3,386,639 | 6/1968 | Unger | 227/14 |
| 3,581,968 | 6/1971 | Unger | 227/118 |
| 3,595,460 | 7/1971 | Pitkin | 227/48 |
| 3,707,427 | 12/1972 | Erickson | 222/263 |
| 3,850,079 | 11/1974 | Fehrs | 227/130 |
| 3,990,152 | 11/1976 | Hirdes | 222/252 |

FOREIGN PATENT DOCUMENTS

| | | | |
|---|---|---|---|
| 235371 | 9/1960 | Australia | 227/14 |
| 2224754 | 11/1953 | Fed. Rep. of Germany | 227/14 |

*Primary Examiner*—William Pieprz
*Attorney, Agent, or Firm*—Brown & Martin

[57] ABSTRACT

Staple depressions formed in a panel by the operation of a pneumatic staple driver are automatically filled with putty from a disposable cartridge. Delivery of the putty from the cartridge is automatically sequenced by the operation of the staple driver trigger. Actuation and release of the staple driver trigger causes a measured quantity of putty to be forced into a putty delivery port. The putty is then pressed into the staple depression.

14 Claims, 6 Drawing Figures

APPARATUS FOR FILLING STAPLE DEPRESSIONS

BACKGROUND OF THE INVENTION

Pneumatic staple drivers are widely utilized in industry for the assembly of panel sections to structural members. For example, in the mobile home industry, panelling, such as simulated wood grain panelling, is frequently utilized to finish the interiors of the mobile home sections. Staple drivers are utilized to secure the panelling to a metal or wooden frame. An experienced crew can become extremely proficient at fitting and securing panelling by this method. However, the operation of the staple driver forces the staple into the panelling and the underlying structural material with a substantial impact. The staple is driven with sufficient force that a depression is produced in the surface of the panelling. The staple itself remains visible. The staple and depression together produce an unacceptable finished appearance. Therefore, it is necessary for a second work crew to follow behind the panelling crew and fill the staple depressions with putty to level the surface of the panelling and to obscure the staple. Putty of a color closely conforming to the color of the panelling is utilized. Thus, the crew must carry a number of different putty colors to finish all of the various shades of panelling utilized by the particular manufacturer. Typically the putty is applied with a putty knife or similar implement. The worker must manually locate each staple depression and fill the depression by hand. It will be apparent that this process is highly labor intensive substantially increasing the cost of manufacture for the mobile home manufacturer. In addition, it frequently results in unfilled staple depressions which produce an unsightly appearance in the finished home.

Therefore, it is desirable to have a device which automates the puttying operation and which eliminates the necessity of a second crew to fill staple depressions. Such a device is particularly desirable where it can quickly accommodate changes in putty colors.

SUMMARY OF THE INVENTION

The invention incorporates a disposable cartridge that is adapted to be mounted on a staple driver or other fastener driver and includes means for dispensing a measured charge of putty from a putty storage chamber into a putty delivery port, pressing the putty from the delivery port out of the cartridge and into the staple depression and applying pressure on the top of the putty charge, to fill the depression and produce a level outer surface. For clarity the invention is described in its use on a staple driver. However, it is to be understood that as used herein the term is defined as encompassing other fastener drivers such as nail drivers.

In the exemplary embodiment, the cartridge and system are pneumatically powered. Pneumatic power has special advantages in the practice of the invention, including that of simplification of the cartridge structure and reduction in the cost of manufacture. In addition, pneumatic power is generally the power utilized with staple drivers in high production applications so that using pneumatic power for the puttying system simplifies the adaptation of conventional staple drivers to the practice of the invention. However, it will be understood that the system may be otherwise powered, such as by electricity.

In the exemplary embodiment, the cartridge accommodate two piston-cylinder combinations as the primary components of the means for delivering a charge of putty. A first air pressure conduit communicates with a piston-cylinder comprising the putty storage chamber. The pressure on the piston forces putty out of the putty storage chamber and into the putty delivery port. Thereafter, pressure delivered through a second air pressure conduit to a second piston-cylinder combination causes the piston to stroke a putty wiper through the putty delivery port and press the charge of putty out of the port and into the staple depression. After the putty application stroke, the wiper piston is returned to its initial position in readiness for the next stroke. Quick disconnect means are provided to rapidly attach and remove the cartridge from the staple driver for replacing empty cartridges or changing putty color.

The system for operating the putty cartridge incorporates a plurality of mini-valves which are operated by the trigger or piloted by the flow of air. The only manually operated control on the system is the trigger valve of the staple driver. Air passed by the trigger valve provides the driving force whereby a staple is driven through the staple delivery track and into the panelling or other material. A portion of the air passed by the trigger valve is utilized by the putty cartridge operating system. The system has two control-actuation functions and a timing function. The first control-actuation function is to cause a measured amount of putty to be delivered to the putty delivery port. After sufficient time has elapsed, the second control-actuation function causes the wiper piston to be driven through its full stroke forcing the charge of putty out of the putty delivery port and pressing it into the staple depression.

The objectives of the invention include a reduction in the man hours required to install a given quantity of panelling. The reduction in labor includes the elimination of one complete work crew. The invention accomplishes the application of putty into a staple depression without requiring any additional operation by the worker using the staple driver. The puttying operation is automatically sequenced by the same trigger actuations utilized in driving staples. The putty cartridge is inexpensive and therefore may be disposed of after the putty supply is exhausted. Each cartridge has sufficient capacity for filling several hundred staple depressions. The cartridge may easily be changed to match putty colors. The operating system requires little maintenance or repair. Since the putty is dispensed automatically after each actuation of the staple driver, all staple depressions are filled with putty. The quantity of putty dispensed is adjustable so that the staple depression will be filled by the proper amount of putty to produce a high quality finished appearance.

Other objects and many attendant advantages of the invention will become more apparent upon a reading of the following detailed description, together with the drawings in which like reference numerals refer to like parts throughout and in which:

DETAILED DESCRIPTION OF THE DRAWINGS

Figure 1:
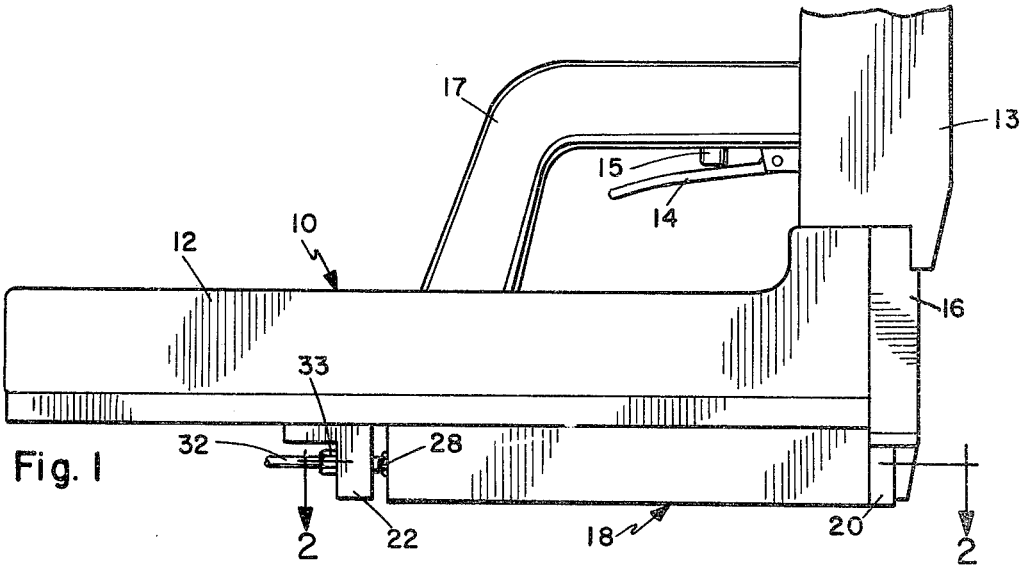
FIG. 1 is a side elevation view of a typical staple driver with the putty cartridge attached.

Referring now to the drawings, there is illustrated in FIGS. 1 through 4, a conventional staple driver 10 adapted according to the invention. The body portion 12 of the staple driver incorporates the staple magazine. A staple from the magazine is driven out of the head 16 by a power cylinder in housing 13. The operator carries the driver by the handle 17 and initiates a staple driving actuation by the trigger 14 and valve operator 15. A putty cartridge 18 according to the invention is supported on the staple driver 10 from section 20 of the head 16 at one end of the cartridge 18, and supported from manifold bracket 22 at the opposite end of the cartridge.

Figure 2:
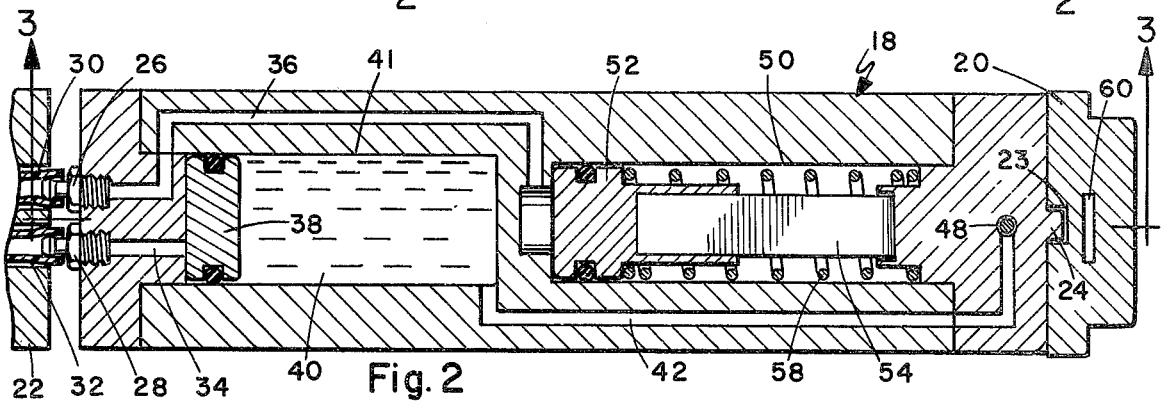
FIG. 2 is an enlarged sectional view taken on line 2—2 of FIG. 1.
Figure 3:
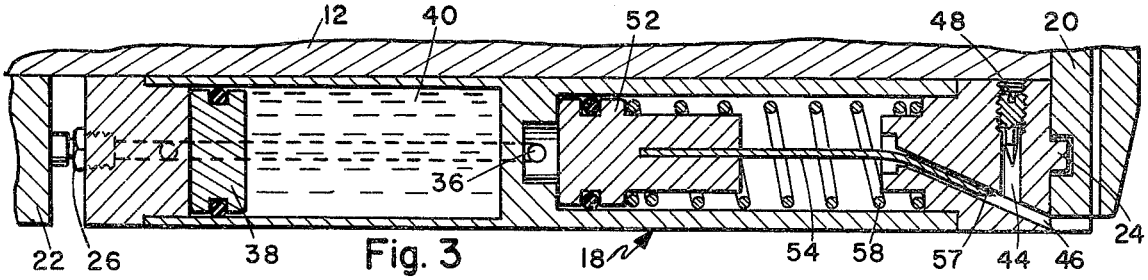
FIG. 3 is a sectional view taken on line 3—3 of FIG. 2.
Figure 4:
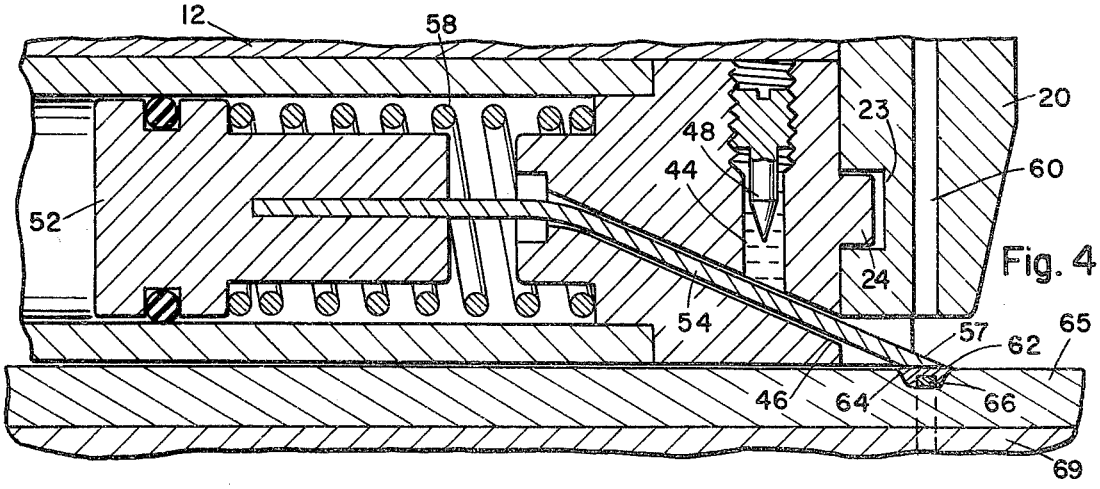
FIG. 4 is an enlarged sectional view similar to a portion of FIG. 3 showing the putty dispensing operation.

The structural details of the cartridge 18 appear particularly in FIGS. 2 through 4. A locking pin 24 is utilized to support the cartridge in retention socket 23. The nipples 26 and 28 at the opposite end of cartridge 18 are utilized to support the cartridge from the manifold bracket 22. The manifold bracket incorporates a first air conduit in the form of flexible tubing 30 and a second air conduit in the form of flexible tubing 32. The flexible tubing is held in the manifold bracket 22 by retention nuts 33. Thus, the cartridge may be inserted onto the gun by pressing the nipples 26 and 28 into the flexible tubing 30 and 32 and then compressing the flexible tubing a sufficient distance to permit the locking pin 24 to pass the outer end of head section 20 and enter the retention socket 23.

The cartridge incorporates piston-cylinders 41 and 50. Air from the tubing 32 passes through the nipple 28 and passage 34 to communicate with the piston 38 in the piston-cylinder combination 41. Pressure on the piston 38 forces it to move to the right (FIG. 2) compressing putty in putty chamber 40 and causing the putty to move through the putty delivery passage 42 to the putty delivery port 46. The volume of putty delivered is controlled by adjustment of the passage 44 through the operation of the adjustment screw 48.

Air in the tubing 30 passes through the nipple 26 and into the passage 36 which communicates with the piston 52 in the piston-cylinder combination 50. The pressure causes the piston 52 to move through a stroke in the piston-cylinder 50. A wiper 54 is secured to and therefore moves with the piston 52. The wiper is an elongated, flexible, flat strip with an angulated terminal portion 57. The flexibility of the wiper permits it to operate in and out of the angulated putty delivery port 46. Thus, upon operation of the piston 52, the wiper 54 moves through and out of the putty delivery port 46 taking withit a charge of putty 62. The charge of putty by wiper portion 57 into the staple depression 64 thereby covering the staple 66 and producing a substantially level finished appearance of the panel 65, as in FIG. 4.

Figure 5:
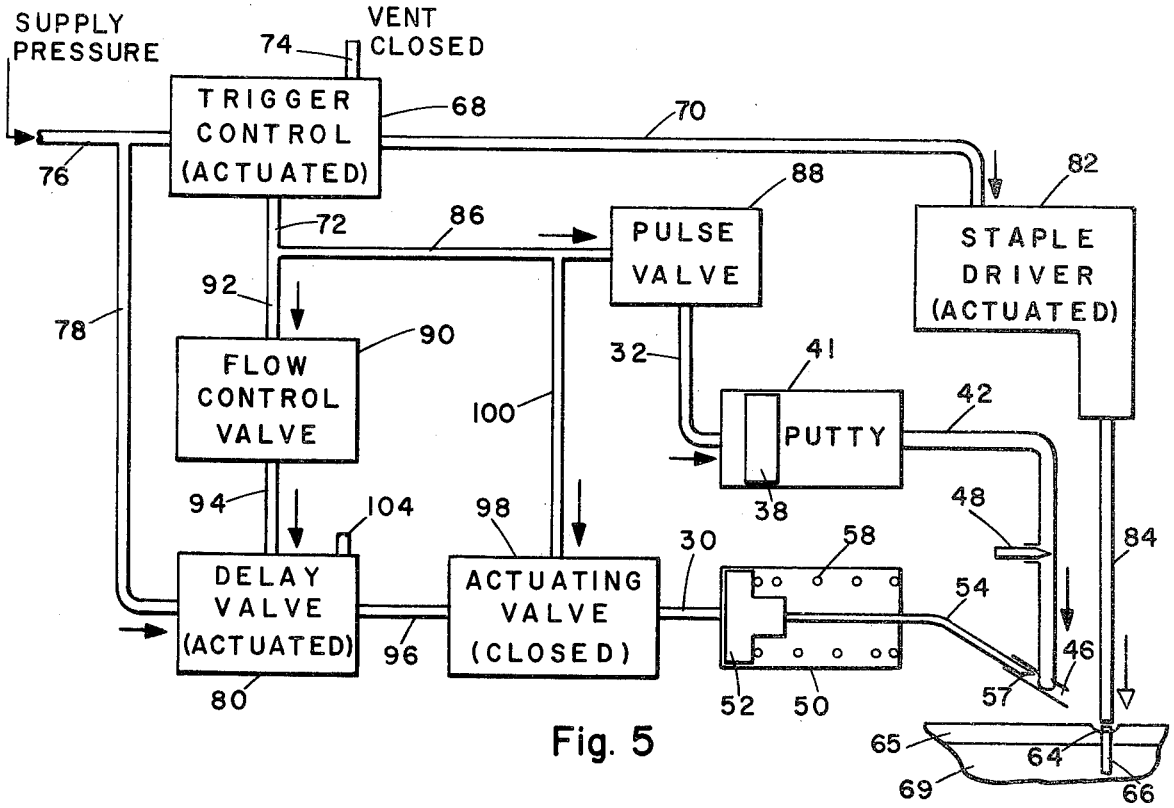
FIG. 5 illustrates schematically the initial actuation of the control system.
Figure 6:
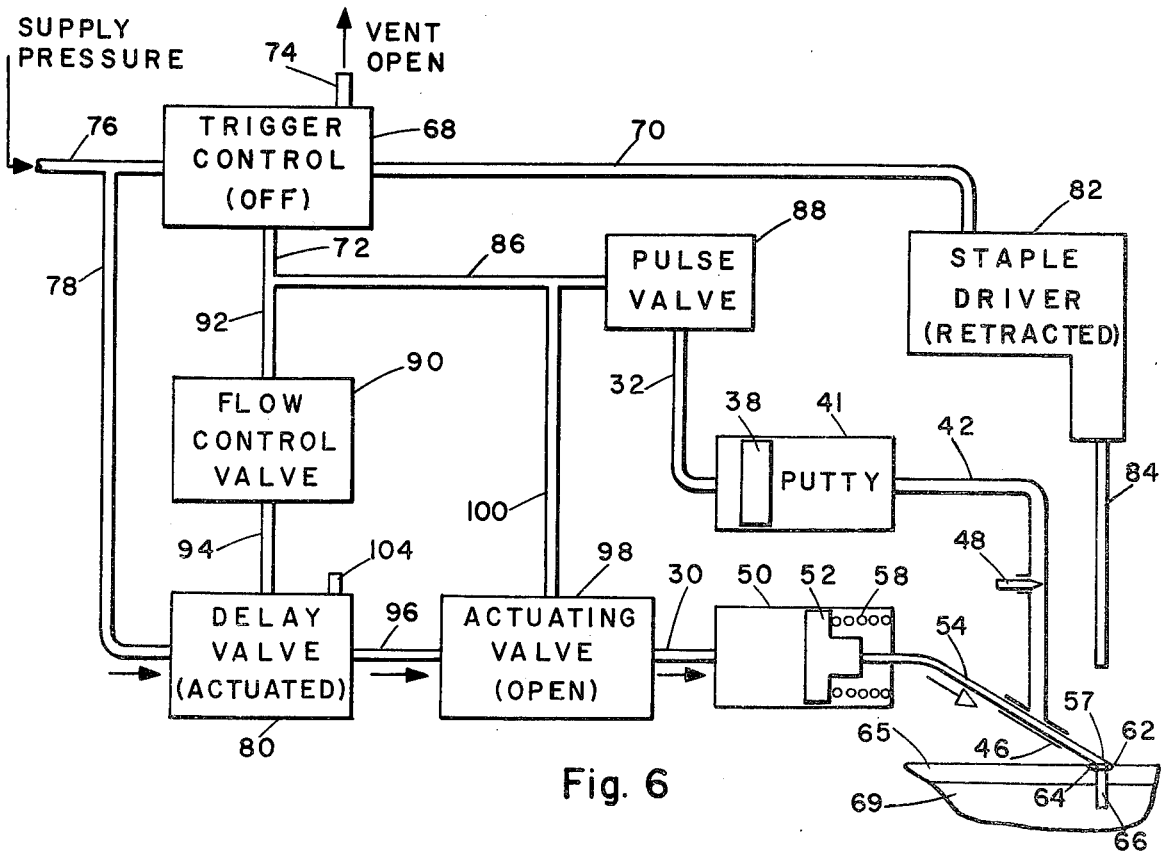
FIG. 6 illustrates schematically the putty dispensing function of the control system.

Referring now to FIGS. 5 and 6, the operation system for the cartridge 18 is illustrated. The trigger control 68 is the valve in the staple driver operated by the trigger 14 and valve operator 15. The operation of the valve is that when the trigger 14 is depressed, air is permitted to flow through the valve on lines 70 and 72. When the trigger 14 is released, the air in lines 70 and 72 is vented to the atmosphere through vent 74. Air under pressure is provided on line 76 to the trigger control valve 68 and on line 78 to the delay valve 80.

The initial operation of the system is illustrated in FIG. 5. When the tripper control valve 68 is opened by operation of the trigger 14, air is delivered on line 70 to the staple driver power unit 82. A staple ram 84 forces a staple through the staple track 60 (see FIG. 4) and drives the staple through the panelling 65 into the support structure 69. Air is applied at the same time to line 72 and passes along line 86 to the pulse valve 88. The function of the pulse valve is to pass a pulse of air under pressure to the line 32 and then close. Thus, a measured pulse of air is delivered to the putty piston cylinder 41 causing the piston 38 to move to the right and force a quantity of putty through passage 42 into the putty delivery port 46. The volume of flow is further regulated by the adjustment screw 48. The putty is delivered to the putty delivery port 46 substantially at the same time that the staple 66 is driven into the support 69. At the same time, air on line 86 is delivered through line 100 to close the actuating valve 98 thereby preventing any air from reaching the putty wiper piston-cylinder 58.

Initial actuation of the trigger valve 68 also passes air through lines 72 and 92 to a flow control valve 90. The flow control valve functions to permit substantially unrestricted flow of air pressure in the direction of the arrow, but to substantially restrict and therefore delay the passage of air in the opposite direction. Therefore, the actuation of the trigger substantially immediately passes air through lines 92 and 94 to the delay valve 80. The air operates the delay valve to open the valve for the passage of powering air on line 78. This air then is available on line 96 to the actuating valve 98. However, as noted above, the actuating valve 98 is closed by the pressure on line 100.

Referring to FIG. 6, the operation of the control system upon the release of the trigger 14 is illustrated. As previously noted, the release of the trigger causes the trigger control valve 68 to be shut off and the air in lines 70 and 72 to be exhausted to the atmosphere on vent 74. Venting of line 70 causes the staple driver ram 84 to be retracted, at the same time the actuating valve 98 is vented through lines 100, 86 and 72 to the vent 74 which releases the actuating valve, causing it to open. Therefore, the pressure available on line 96 now passes through the actuating valve 98 and into line 30 to cause the piston 52 to stroke, thereby forcing the wiper 54 and putty charge 62 out of the putty delivery port 46 and pressing the putty charge 62 into the staple depression 64.

As previously noted, the release of the trigger 14 results in the opening of the vent 74. Therefore, lines 70 and 72 are vented to the atmosphere. Accordingly, pressure is free to flow through line 92 to the vent 74. However, reverse flow through the valve 90 is restricted, and therefore a substantial period of time elapses before the pressure on line 94 drops below the value necessary to actuate delay valve 80. When the delay valve is released, it shuts off the supply pressure and opens vent 104. Therefore, air under pressure in the piston cylinder 50 may pass through line 34, actuating valve 98, and line 96 to vent 104 and the atmosphere. This release of pressure permits the spring 58 to return the piston 52 and wiper 54 to their initial position.

It will be noted that a single actuation and release of the trigger 14 sequences multiple operations. The staple is driven and the staple driver ram retracted. Putty is forced from the putty chamber 41 into the delivery port 46. Thereafter, the putty wiper piston is cycled by a first actuating operation, where the putty wiper presses the charge of putty into the staple depression and by second timed return stroke powered by the spring 58. The actual time sequence is so short that the staple driver may be operated at as rapid a pace as the worker can locate and position the driver.

The several mini-valves may be mounted internally or externally on the driver body 10. Suitable valves for the functions described are available from Clippard Instruments and Laboratory, Inc. under the following model numbers:

| | |
|---|---|
| Flow Control Valve | MFC-2 |
| Delay Valve | MAU-2 |
| Actuating Valve | MAVO-2 |
| Pulse Valve | PV-1 |

Having described our invention, we now claim:

1. In a staple driver incorporating a trigger for actuating the staple mechanism, an automatic putty dispensing system comprising:

dispensing means on said staple driver responsive to the staple driver trigger for delivering a measured charge of putty to a putty delivery port and for pressing said charge of putty from said putty delivery port into a staple depression, said dispensing means including force delivery means controlled by said trigger for producing a controlled force on the putty in a putty storage chamber and forcing putty out of said chamber, said dispensing means further comprising a reciprocal wiper for reciprocal movement in and beyond a channel guide for pressing the putty into the staple depression, and means for initiating the pressing of the putty into the staple depression after the cycling of said staple driver.

2. The system according to claim 1 wherein:

said putty wiper comprises a flexible elongated member secured to said piston.

3. The system according to claim 2 wherein:

said delivery port is angulated with respect to and terminates immediately adjacent the staple track of said staple driver.

4. A putty cartridge for a staple driver incorporating an automatic putty dispensing system, said cartridge incorporating:

a putty storage chamber, a first air pressure passage, a putty delivery port, means responsive to air pressure in said first passage for delivering a charge of putty from said putty storage chamber into a putty delivery port, a second air pressure passage, means responsive to air pressure in said second passage for pressing said charge of putty into a staple depression, said means for pressing comprising a piston-cylinder combination, a putty wiper, the distal end of said putty wiper moving in and beyond said delivery port for pressing a charge of putty out of said port beyond said port and into said staple depression.

5. A cartridge according to claim 4 wherein:

said means for delivering a charge of putty comprises a piston-cylinder combination.

6. A cartridge according to claim 5 wherein:

said means for delivering a charge of putty further comprises means for regulating the volume of said charge of putty.

7. A cartridge according to claim 6 wherein:

said means for regulating the volume of putty comprises an adjustment screw.

8. The cartridge according to claim 4 wherein:

said wiper comprises a flexible elongated member.

9. A cartridge according to claim 8 wherein:

said putty wiper has a substantially rectangular cross-section.

10. A cartridge according to claim 4 wherein:

said putty delivery port is angulated with respect to said movement of said wiper piston.

11. In a staple driver incorporating a trigger for actuating the staple driving mechanism, an automatic putty dispensing system comprising:

dispensing means on said staple driver responsive to the staple driver trigger for delivering a measured charge of putty to a putty delivery port and for pressing the said charge of putty from said putty delivery port into a staple depression, said dispensing means including a valve controlled by said trigger for regulating the flow of air from a source of air under pressure, a putty storage chamber, said putty storage chamber being in pneumatic communication with said trigger controlled valve for producing a flow of air under pressure to said putty storage chamber and forcing the putty out of said chamber, a piston-cylinder combination, the piston in said piston-cylinder combination being constrained for limited reciprocating movement, a putty wiper secured to said piston, the distal end of said putty wiper moving in and out of said delivery port for pressing a charge of putty out of said port, beyond said port, and into said staple depression.

12. The system according to claim 11 wherein:

said means for pneumatic communication between said trigger valve and said putty chamber incorporates a pulse valve for delivering a predetermined pulse of air pressure to said putty chamber.

13. The system according to claim 11 wherein:

said means for pressing said charge of putty incorporates delay means for applying pressure to said wiper piston-cylinder for a predetermined period of time and for venting pressure from said wiper piston-cylinder after the expiration of said predetermined period of time.

14. The system according to claim 13 wherein:

said delay means comprises a flow control valve and a delay valve, said flow control valve being connected to said trigger valve and for permitting substantially unrestricted flow of air from said trigger valve to said display valve while restricting the flow of air from said delay valve to said trigger valve, said air pressure from said flow control valve actuating said delay valve and permitting air under pressure to pass through said delay valve to said wiper piston-cylinder.

* * * * *